US005335581A

United States Patent [19]

Simon et al.

[11] Patent Number: 5,335,581

[45] Date of Patent: Aug. 9, 1994

[54] SYSTEM FOR LOADING A ROUND, SUCH AS A TELESCOPED ROUND, INTO A PIVOTING CHAMBER OF A GUN

[75] Inventors: Georges Simon, Saint-Germain-du-Puy; Michel Baubois, Bourges, both of France

[73] Assignee: Giat Industries, Versailles, France

[21] Appl. No.: 64,706

[22] Filed: May 20, 1993

[30] Foreign Application Priority Data

May 21, 1992 [FR] France ..... 92 06197

[51] Int. Cl.[5] ..... F41A 9/02; F41A 9/45

[52] U.S. Cl. ..... 89/156; 89/33.03; 89/33.04

[58] Field of Search ..... 42/9, 39.5; 89/9, 33.03, 89/33.04, 155, 156

[56] References Cited

U.S. PATENT DOCUMENTS 4,827,829 5/1989 Stoner ..... 89/43.01

FOREIGN PATENT DOCUMENTS 4581 10/1979 European Pat. Off. .
3805620 9/1989 Fed. Rep. of Germany .
3427875 4/1992 Fed. Rep. of Germany .
306006 2/1929 United Kingdom .
2153497 8/1985 United Kingdom .

*Primary Examiner*—Stephen C. Bentley
*Attorney, Agent, or Firm*—Bell, Seltzer, Park & Gibson

[57] ABSTRACT

The invention relates to a system for loading a round such as a telescoped round into a pivoting chamber of a gun, in particular a medium caliber gun. The system comprises a feed device secured to the oscillating mass of the gun and laterally offset relative to the gun barrel. The feed device is situated between the trunnion axis of the gun and the pivoting chamber. The system further includes an insertion device for inserting a round into the chamber, which insertion device is secured to the recoil mass of the gun, is situated above the barrel, and lies substantially in the vertical plane in which the chamber pivots. The round is conveyed from the feed device to the insertion device by a feed star mounted to rotate about the barrel of the gun.

20 Claims, 7 Drawing Sheets

SYSTEM FOR LOADING A ROUND, SUCH AS A TELESCOPED ROUND, INTO A PIVOTING CHAMBER OF A GUN

FIELD OF THE INVENTION

The present invention relates to a system for loading a round, such as a telescoped round into a pivoting chamber of the barrel of a gun, in particular a medium caliber gun, the gun comprising an oscillating mass trunnioned about a horizontal axis in a support frame, and a recoil mass that includes in particular the gun barrel, the pivoting chamber, and a sleeve, said chamber pivoting, inside same sleeve, in reciprocating manner in a vertical plane between a "firing" position and a "loading" position, said two positions being angularly offset from each other by an angle a lying in the range 0° to 90°, the loading device being of the type comprising a control device for controlling pivoting of the chamber, a feed device for feeding rounds, and an insertion device for inserting a round into the chamber when it is in its loading position.

BACKGROUND OF THE INVENTION

Loading systems of the above-mentioned type are known, in particular from documents U.S. Pat. No. 4,827,829 and EP-0 004 581.

In document U.S. Pat. No. 4,827,829, the chamber pivots in a vertical plane about a horizontal axis in alignment with the trunnion axis of the gun. Whatever the elevation angle of the gun, the chamber, when in its loading position, is always in alignment with a vertical axis, and the new round is loaded through the bottom opening of the chamber. In other words, the pivot angle of the chamber varies as a function of the elevation angle of the gun, and it is always equal to the complementary angle to the elevation angle. The feed device and the device for loading a round into the chamber (not described in detail in that document) are secured to a stationary support, and it is merely specified that they do not include a flexible coupling device between the loading device and the breech assembly of the gun for compensating variations in the elevation angle of the gun between two round loading operations. It should be observed that in that document, a round can be loaded into the chamber only after the gun has returned to the battery position, thereby reducing firing rates.

In document EP-0 004 581, the chamber pivots through 360° in steps of 90°. In other words, after pivoting through 90°, the chamber has passed from a firing position to a loading position, or vice versa. The chamber pivots in a vertical plane about an axis parallel to the trunnion axis of the gun. Rounds are stored in a magazine in the form of a bar situated above the chamber. Rounds are disposed vertically and they are loaded one by one by means of a lever when the chamber is in one of its two loading positions, both of which positions are in alignment along a vertical axis perpendicular to the axis of the barrel.

The magazine is linked in translation to the chamber and a round is loaded during the return stage of the recoil motion of the gun. In general, the system described in that document requires large amounts of volume that are incompatible with it being used for a medium caliber gun, in particular when mounted on an armored vehicle. Furthermore, the displacement of the feed device during the recoil motion of the gun is detrimental to proper operation thereof.

OBJECT AND BRIEF SUMMARY OF THE INVENTION

The object of the invention is to design a system for loading rounds, in particular of the telescoped type, for use with a medium caliber gun, which system should be capable of mitigating the drawbacks of above-mentioned systems, while also obtaining other advantages.

To this end, the invention provides a loading system of the above-specified type, wherein the feed device is secured to the oscillating mass of the gun, is laterally offset relative to the gun barrel, and is situated between the trunnion axis of the gun and the pivoting chamber, in that the insertion device for inserting a round into the chamber is secured to the recoil mass of the gun, is situated above the barrel, and is substantially in the vertical pivot plane of the chamber, and in that each round is conveyed from the feed device to the insertion device by a feed star mounted to rotate about the sleeve of the gun.

According to another feature of the invention, the feed device comprises a loading station where each round is substantially in alignment with the trunnion axis of the gun, and a transfer device that operates by pivoting to bring the round from the loading station to the feed star.

In an embodiment of the invention, the transfer device comprises a finger driven by a chain device so as to cause the round to pivot through an angle of about 90°.

According to another feature of the invention, the device for inserting a round into the chamber comprises a device for taking the round situated at the top of the feed star by pivoting the round in a vertical plane through an angle of about 30°, so as to bring it into an intermediate position in which it is in alignment with the chamber axis, and a device for loading the round into the chamber.

In an embodiment of the invention, the device for taking the round situated at the top of the feed star is constituted by a pivoting lever which is controlled by a sliding lever, the sliding lever being actuated by a rod driven by a chain device, said rod also constituting the device for loading the round into the chamber.

The device for controlling pivoting of the chamber comprises a cam mounted to rotate about an axis perpendicular to the axis of the barrel, and coupling means mounted between the cam and the chamber for transforming the rotary motion of the cam into reciprocating pivoting motion of the chamber through an angle of about 30°.

According to another feature of the invention, the coupling means between the cam and the chamber comprises a spur having one end fixed to the chamber, a ball joint slidably mounted on the spur, and a roller or wheel mounted around the ball joint, the whell being held captive in a guide path forming groove of the cam.

According to anther feature of the invention, the groove of the cam comprises four successive sectors respectively associated with: the chamber being held in an open or loading position; the chamber moving to its firing position; the chamber being held in its firing position; and the chamber being moved to its loading position.

According to another feature of the invention, the cam controlling the pivoting of the chamber, the transfer device for bringing a round from the loading station to the feed star, the device for taking the round situated at the top of the star, and the device for loading a round into the chamber are advantageously all driven by a single drive member, such as a motor and gear box unit, having an outlet shaft which is coupled via intermediate gearing to each of said devices.

Finally, according to another feature of the invention, the loading system further includes a device for ejecting a spent case present in the chamber, said device comprising a reception/ejection cylinder driven with reciprocating pivoting motion synchronously with the motion of the chamber in such a manner as to be in alignment with the chamber when the chamber is open for the purpose of receiving a case that compresses a piston received in the cylinder, and for ejecting the case into an exhaust chute by the piston relaxing once the chamber is back in the firing position.

BRIEF DESCRIPTION OF THE DRAWINGS

Other advantages, features, and details of the invention appear from the following description made with reference to the accompanying drawings that are given purely by way of example, and in which.

MORE DETAILED DESCRIPTION

Figure 2:
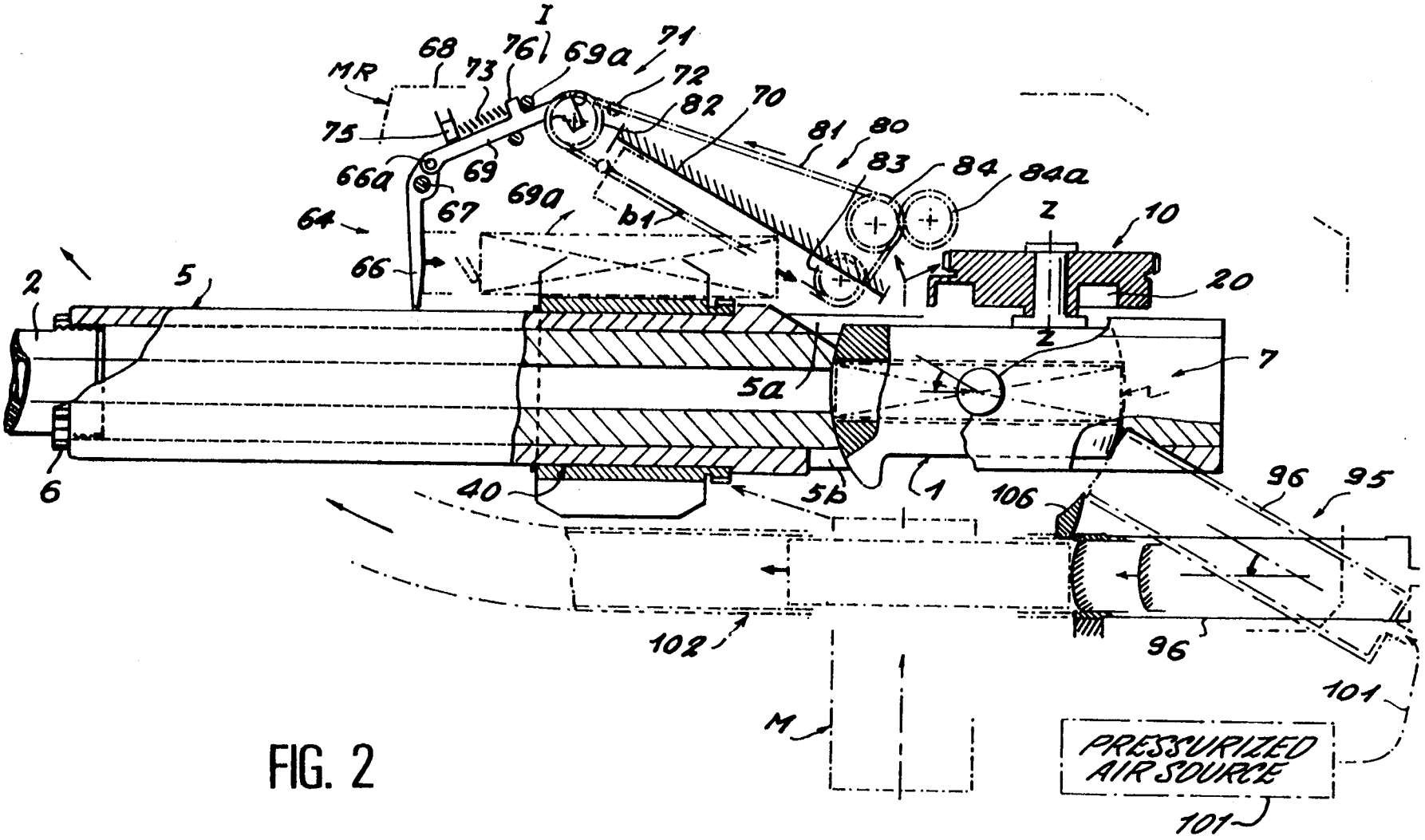
FIG. 2 is a partially cutaway fragmentary section in a vertical plane including the axis of the barrel.
Figure 3:
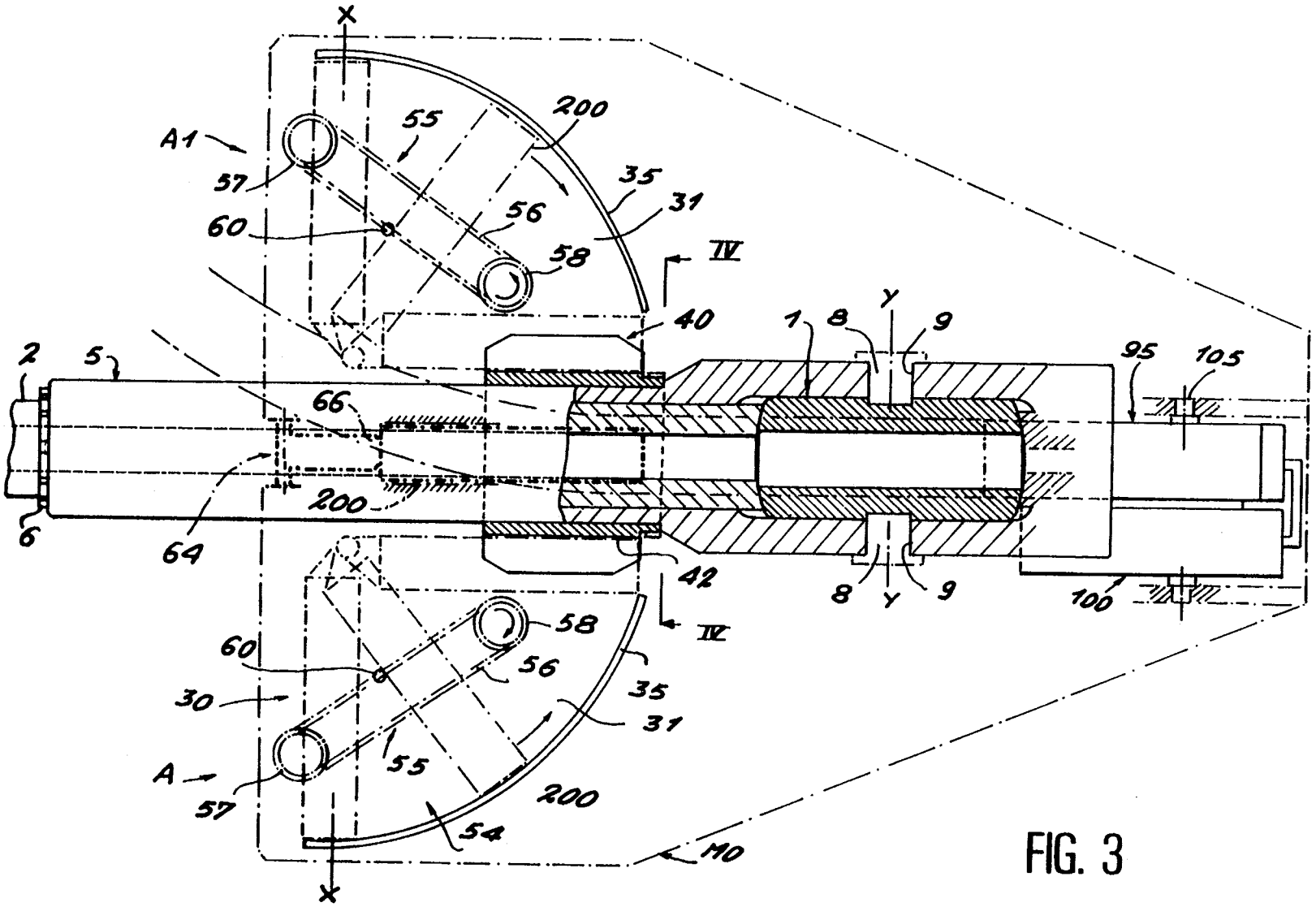
FIG. 3 is a simplified plan view of the loading system of the invention.
Figure 4:
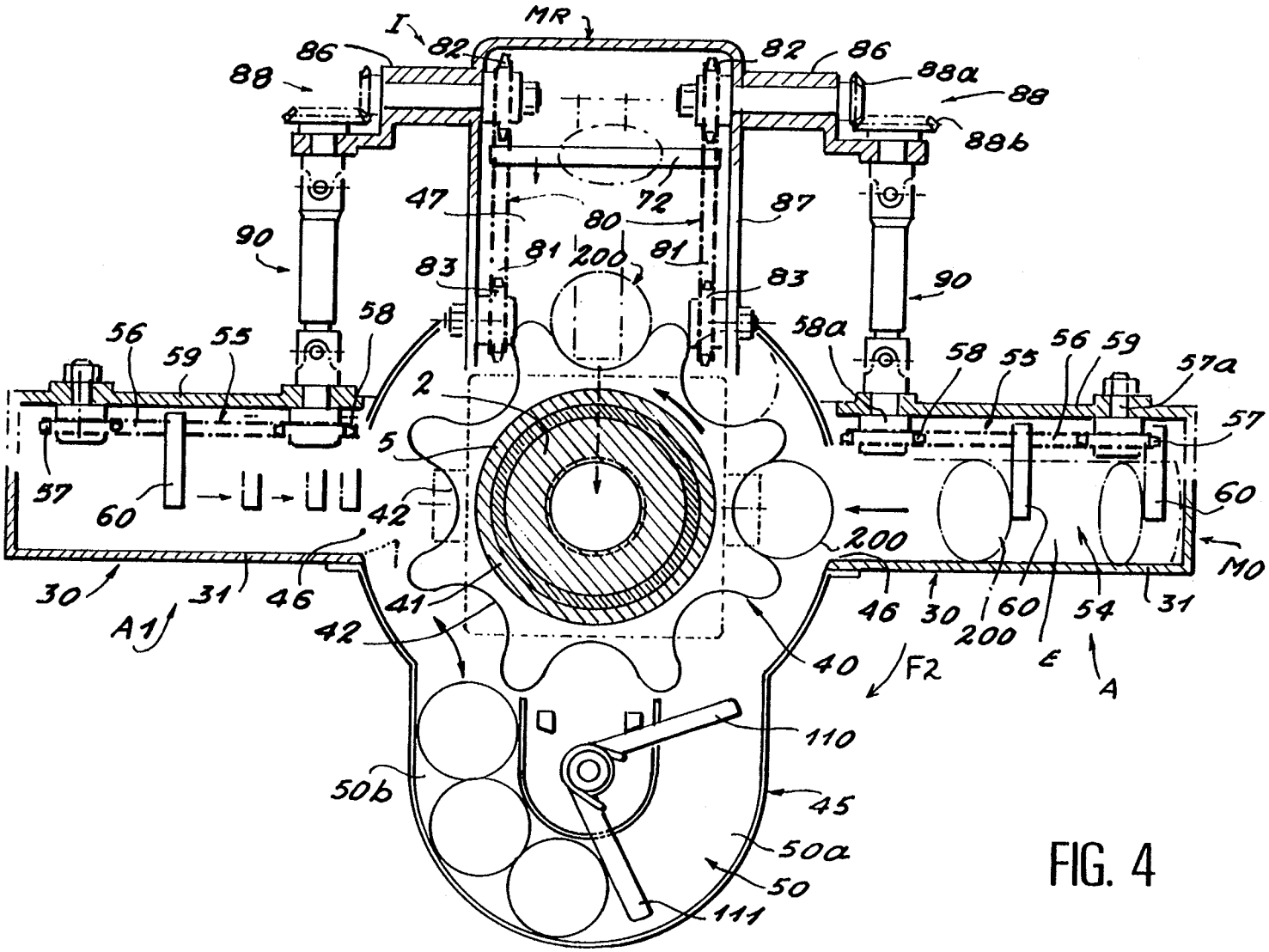
FIG. 4 is a section view on line IV—IV of FIG. 3.

A system of the invention for loading a round into a pivoting chamber 1 of a gun is shown in FIGS. 2 to 4.

In general, the gun comprises an oscillating mass MO trunnioned about an axis X—X that is substantially horizontal and that is supported by a support frame (not shown), and a recoil mass MR including in particular: the chamber 1, the gun barrel 2, and a sleeve 5. The recoil mass MR forms a portion of the oscillating mass MO, but it is movable relative thereto during recoil of the gun following the firing of a round. The rear end of the barrel 2 is inserted in the sleeves 5 and is screwed in place by a threaded ring 6 (FIG. 2).

Figure 2A:
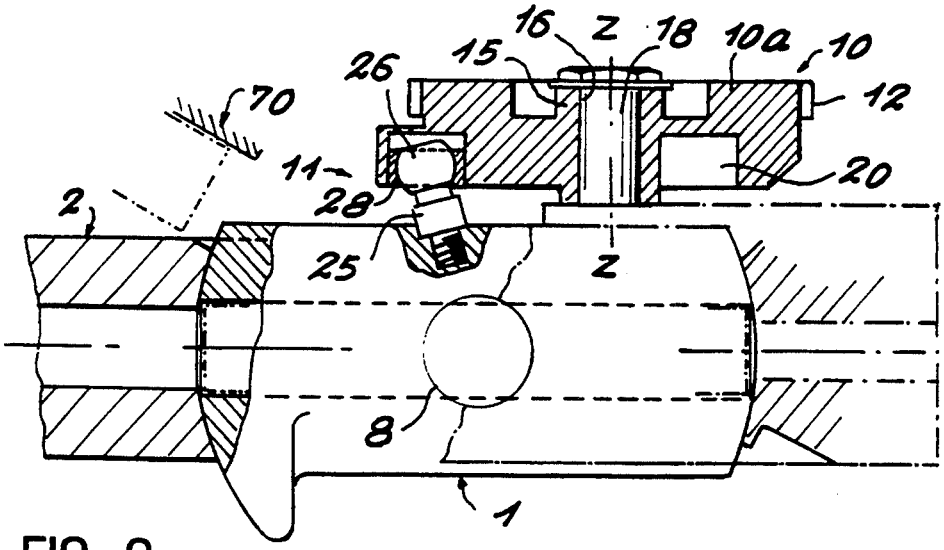
FIGS. 2*a* and 2*b* are diagrammatic section views showing the device for controlling reciprocating pivoting of the chamber.
Figure 2B:
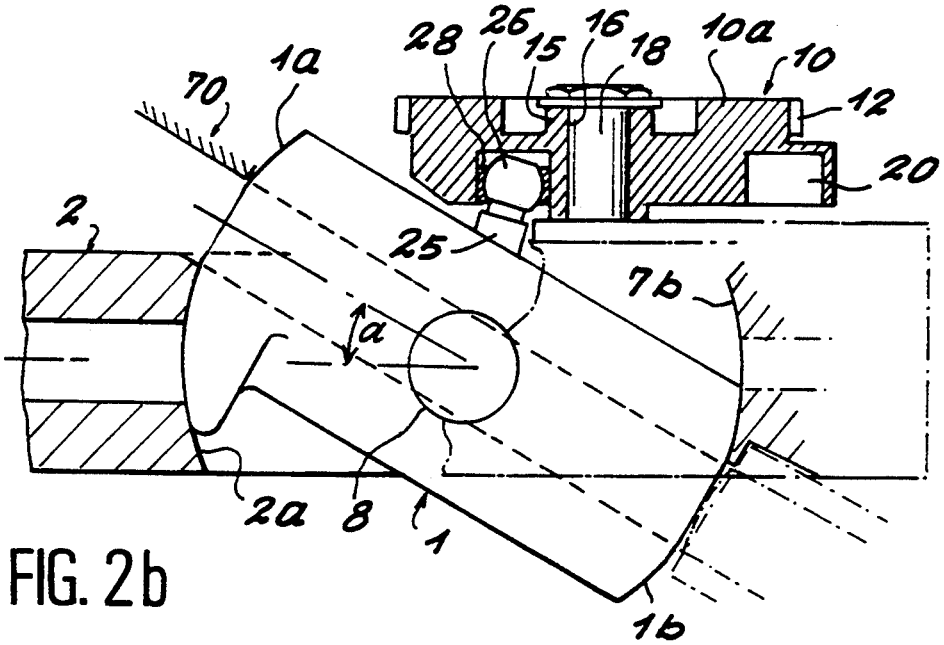

With reference in particular to FIG. 2*b*, the chamber 1 comprises an elongate hollow cylindrical body whose two end surfaces 1*a* and 1*b* are each spherically convex in shape. The chamber 1 is mounted in the rear portion of the sleeve 5 and includes two diametrically opposite openings, namely an upper opening 5*a* and a lower opening 5*b*, thereby enabling the chamber 1 to rock in a vertical plane (FIG. 2).

A conventional percussion system 7 is engaged and secured in a central opening situated behind the sleeve 5. The rear end surface 2*a* of the barrel 2 and the front end surface 7*b* of the percussion system 7 are spherically concave in shape and complementary to the spherically convex shapes of the end surfaces 1*a* and 1*b* of the chamber 1 (FIG. 2*b*).

The chamber 1 is pivotally mounted halfway along its length about a substantially horizontal axis Y-Y that is parallel to the trunnion axis X-X of the gun (FIG. 3). This pivot axis Y-Y is embodied by two stud axles 8 rotatably received in respective ones of two diametrically opposite openings 9 of the sleeve 5. Each stub axle 8 is secured to the wall of the chamber 1 by means of a screw, for example.

The chamber 1 is caused to pivot with reciprocating motion about its axis Y-Y by means of a cam 10 which is rotated by a drive member M such as a motor and gear box unit (FIGS. 2 and 2*a*), and by means of a device 11 installed between the cam 10 and the chamber 1 to transform the rotary motion of the cam 10 into reciprocating pivoting motion of the chamber 1.

The cam 10 is constituted by a disk 10*a* whose outer peripheral edge supports a set of teeth 12 that mesh with a gear wheel (not shown) constrained to rotate with the outlet shaft of the motor and gear box unit M via a transmission (not shown). The cam 10 includes a central projection 15 that is axially pierced by an opening 17 through which there passes a screw 18 that is fixed in the sleeve 5. The screw 18 embodies the axis of rotation Z-Z of the cam 10, which axis Z-Z is perpendicular to the pivot axis Y-Y of the chamber 1. The disk 10*a* has a groove 20 provided in its face that is adjacent to the sleeve 5, which groove 20 extends around the projection 15.

The motion transforming device 11 comprises a coupling spur 25 having one end screwed into the wall of the chamber 1 (FIGS. 2*a* and 2*b*). The opposite end of the coupling spur 25 carries a slidably mounted ball joint 26. A roller or wheel 28 is mounted about the ball joint 26 and is received in the groove 20 of the cam 10 so as to cause the chamber 1 to pivot with reciprocating motion when the cam 10 rotates.

Figure 2C:
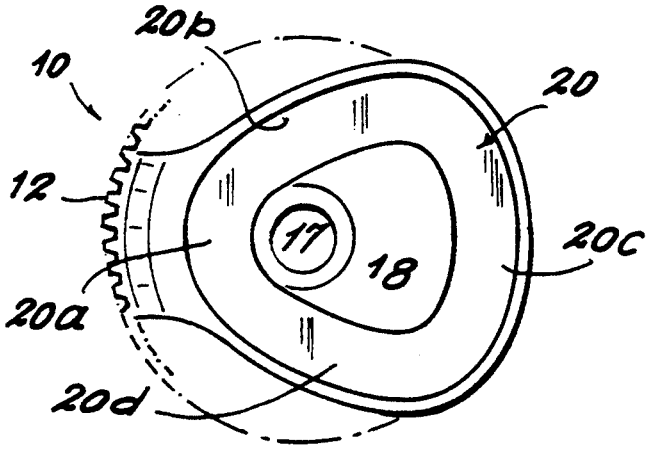
FIG. 2*c* is a diagrammatic plan view of the cam of the device for controlling reciprocating pivoting of the chamber.

With reference to FIG. 2*c*, the groove 20 has four successive sectors 20*a*, 20*b*, 20*c*, and 20*d*. The sector 20*a* extends over an arc of a circle centered on axis of rotation of the cam 10. While the wheel 28 is moving along the sector 20*a*, the chamber 1 remains stationary and it is held in its loading position. As the wheel 28 moves along the sector 20*b* following the sector 20*a*, in the direction of rotation of the cam, it drives the chamber 1 so as to pivot it towards its firing position. The following sector 20*c* extends over an arc of a circle that is likewise centered on the axis of rotation of the cam 10. When the wheel 28 moves along this sector 20*c*, the chamber 1 remains stationary and is held in its firing position. Finally, when the wheel 28 moves along the last sector 20*d*, it pivots the chamber 1 towards its loading position.

During rotation of the cam 10, the wheel 28 runs along all four sectors of the groove 20, thereby giving rise to the reciprocating pivoting motion of the chamber 1 through an angle of about 30°. In other words, for one turn of the cam 10, the chamber 1 passes from a firing position (or a loading position) to a loading position (or a firing position) and then returns to the firing position (or the loading position).

The loading system associated with the chamber 1 comprises a feed device A that receives the rounds, and an insertion device I for inserting said rounds into the chamber 1, which devices are described below.

Figure 1:
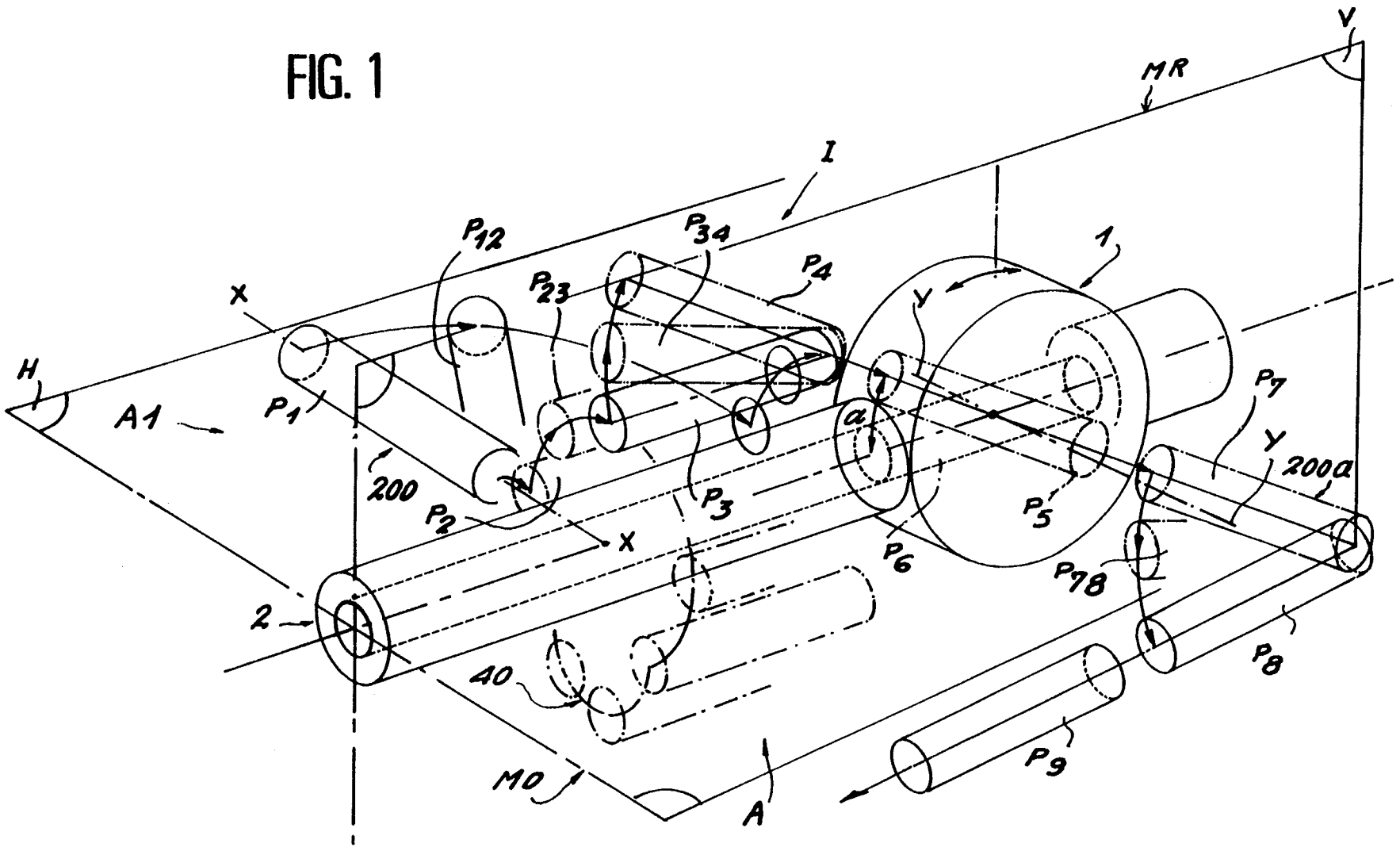
FIG. 1 is a perspective view for showing the path followed by a round through the loading system of the invention.

With reference to FIG. 3, the feed device A is secured to the oscillating mass MO of the gun, and it is organized on a plate 30 that is offset laterally relative to the gun barrel 2. The plate 30 is situated between the trunnion axis X-X of the gun and the chamber 1, and it extends in a plane H that is substantially parallel to the plane defined by the trunnion axis X-X of the gun and the pivot axis Y-Y of the chamber (FIG. 1).

The plate 30 includes a thrust plate 31 in the form of a circular sector whose angle at the center is about 90°, with one side being parallel to the trunnion axis X-X of the gun, and with its other side being parallel to the axis of the barrel 2 and being adjacent thereto. The side in the form of a circular arc is surmounted by a rim 35.

With reference to FIG. 4, the feed device A cooperates with a feed star 40 whose cylindrical body 41 is mounted to rotate about the sleeve 5. This star 40 forms a portion of the recoil mass MR of the gun and at its periphery it includes a succession of half-open housings 42 that extend parallel to the axis of the star 40.

The feed star 40 is surrounded by a casing 45 which includes two diametrically-opposite inlet openings 46 situated generally in the plane of the feed device A, and a top outlet opening 47. The dimensions of the openings 46 and 47 are such as to enable them to pass a round.

The bottom of the casing 45 forms a magazine 50 in which rounds can be stored, which magazine is described below.

The feed star 40 is rotated by a drive device (not shown) that is controlled from the motor and gear box unit M.

The feed device A includes a loading station 54 where each round is brought semi-automatically or automatically. As shown in FIG. 3, this loading station 54 is located level with the portion of the thrust plate 31 of the plate 30 that is situated generally on either side of the trunnion axis X-X of the gun. In other words, each round arrives at the loading station 54 being substantially in alignment with the trunnion axis X-X of the gun.

To convey a round from the loading station 54 onto the feed star 40, a transfer device 55 is provided comprising a chain and a drive finger which causes the round to pivot through an angle of about 90° so as to bring it parallel to the axis of the star 40 and so as to insert it in a housing 42 thereof via the opening 46 in the case 45.

The transfer device 55 comprises a chain 56 disposed around two sprockets 57 and 58, together with a drive finger 60 which is secured to the chain 56 and which extends perpendicularly to the plane of the chain. More precisely, with reference to FIG. 4, the two sprockets 57 and 58 are supported to rotate about two axes **57*a* and 58*a* carried by a support plate 59 extending parallel to and over the thrust plate 31 of the plate 30. The two sprockets 57 and 58 are situated beneath the support plate 59 and at a distance from the thrust plate 31 that is greater than the width of one round. The chain 56 extends parallel to the plates 31 and 59, and the drive finger 60 projects into the space E defined between the chain 56 and the thrust plate 31. The drive device for driving the chain 56** is described below.

In the example described herein, two similar feed devices A and A1 are provided situated on opposite sides of the gun barrel 2, with the feed star 40 receiving rounds equally well from either of the devices A and A1 (FIGS. 3 and 4). The feed star 40 is rotated from the motor and gear box unit M and it is controlled synchronously with the transfer device 55 and the cam 10.

The insertion device I for inserting rounds into the chamber 1 is secured to the recoil mass MR of the gun and it is generally situated above the barrel 2 and in a vertical plane V perpendicular to the axis of the barrel 2 (FIG. 1). This insertion device I comprises a round-taking device 64 for taking a round from the feed star 40 and a loading device for loading the round into the chamber 1 via the front portion thereof.

With reference to FIG. 2, the round-taking device 64 comprises a first lever 66 which is pivotally mounted near one end in a vertical plane about a substantially horizontal pin 67. The pin 67 is fixed to a vertical support 68 which forms a portion of the recoil mass MR of the gun. At its end close to its pivot pin 67, the pivot lever 66 is hinged at **66*a* to the end of a second lever 69 which is slidably mounted between two pegs 69*a* fixed to the support 68. The sliding lever 69 is coplanar with the pivoting lever 66, and overall the two levers are at an angle of 90° to each other. The pivot lever 66 extends substantially vertically, and it is situated slightly in front of the feed star 40**.

The round-taking device 64 for taking a round by means of the two levers 66 and 69 is intended to convey the round situated at the top of the star 40 facing the outlet opening 47 of the casing 45 towards the chamber 1 while causing the round to pivot through an angle close to 30° so as to bring it into alignment with the axis of the chamber 1 once it is in the loading position. In order to make this pivoting movement of the round possible, a guide ramp 70 is provided fixed to the support 68 and against which an end of the round bears while the round is pivoting. The guide ramp 70 extends parallel to the axis of the chamber 1 when the chamber is in its loading position, i.e. it is at an angle of about 30° with the gun barrel 2.

The round-taking device 64 is under the control of a device 71 which includes a horizontal drive rod 72 for bearing against the free end of the sliding lever 69, and a spring 73 mounted parallel to said lever 69 with one end bearing against an abutment 75 secured to the support 68 while its other end is bearing against a radial shoulder 76 secured to the lever 69. The stationary abutment 75 is generally situated between the shoulder 76 and the hinge **66*a* between the two levers. Thus, when the drive rod 72 pushes the sliding lever 69 against the spring 73, the lever 69 is moved in translation while being guided by the two guide pegs 69*a*. The translation motion of the sliding lever 69 causes the lever 66 to pivot inwards towards the guide ramp 70**.

With reference to FIGS. 2 and 4, the drive rod 72 is actuated by a chain device 80 in the present example. More precisely, the two ends of the drive rod 72 are fixed to two respective chains 81 situated in two parallel vertical planes on opposite sides of the outlet opening 47 of the casing 45 in which the feed star 40 is received.

The insertion device I for inserting a round in the chamber 1 and situated above the gun barrel 2 is common to the two feed devices A and A1 which are situated on respective opposite sides of the barrel 2.

With reference to FIG. 2, each chain 81 is wound over two sprockets 82 and 83 and over a driving sprocket 84. The sprocket 82 is raised relative to the sprocket 83 and it is generally situated level with the sliding lever 69 of the device 64 for taking a round from the feed star 40. The sprocket 83 is generally situated level with the inlet to the chamber 1, so that the length b1 of the chain 81 defined between the two sprockets 82 and 83 is parallel to the axis of the chamber 1 when the chamber is in its loading position. In other words, the length b1 is at an angle of 30° to the barrel 2. The driving sprocket 84 for each chain 81 is situated close to the sprocket 83 and it is coupled in rotation with the outlet shaft of the motor and gear box unit M by means of a set of intermediate gear wheels symbolized by reference 84*a*.

With reference to FIG. 4, the horizontal drive shaft for each sprocket 82 is rotatably supported by a bearing 86 mounted on a fixed vertical support 87, and it is coupled to a bevel gear 88*a* of a 90° gear device 88 whose other bevel gear 88*b* is coupled to one end of a vertical telescopic constant-velocity joint 90. The other end of the constant-velocity joint 90 is constrained to rotate with the drive shaft 58*a* for rotating the sprocket wheel 58 of the transfer device 55 of the associated feed device.

These two constant-velocity joints 90 associated with respective ones of the two feed devices A and A1 enable a driving connection to be maintained with the insertion device I during the recoil motion of the gun.

Thus, the feed device A, the insertion device I, the cam 10, and the star 40 can all be driven synchronously from a single drive unit M.

The device for loading a round into the chamber 1 is advantageously constituted by a guide ramp 70 and by the drive rod 72, as appears from the description below of the operation of the loading system.

Figure 8:
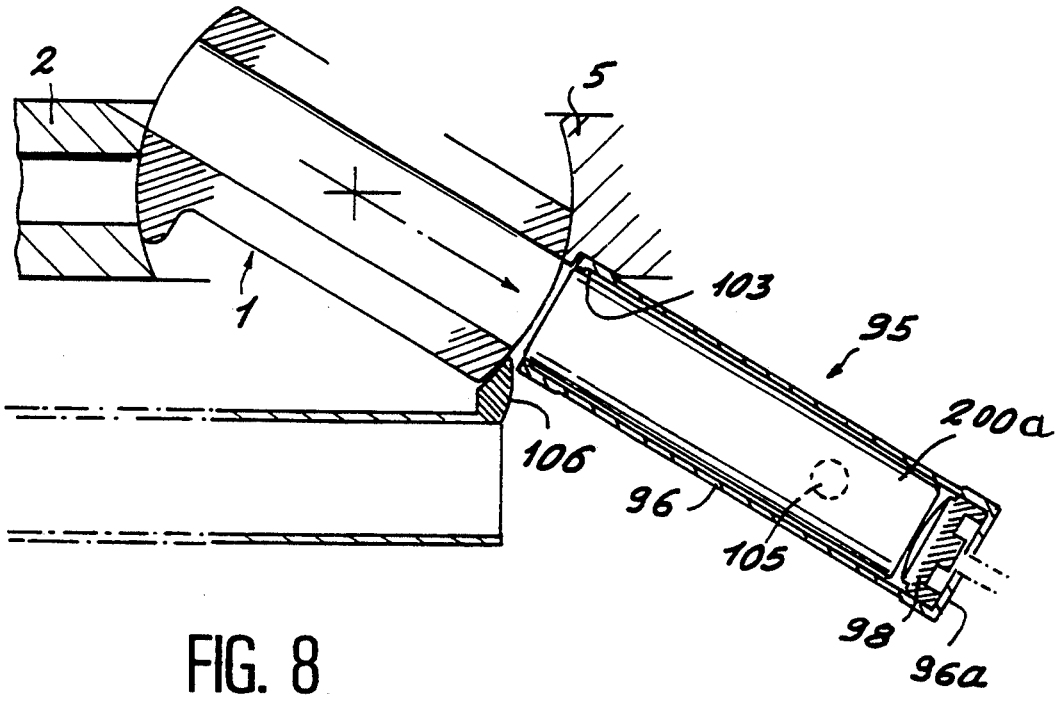
FIGS. 8 and 9 are diagrams for explaining how the case ejection device operates.
Figure 9:
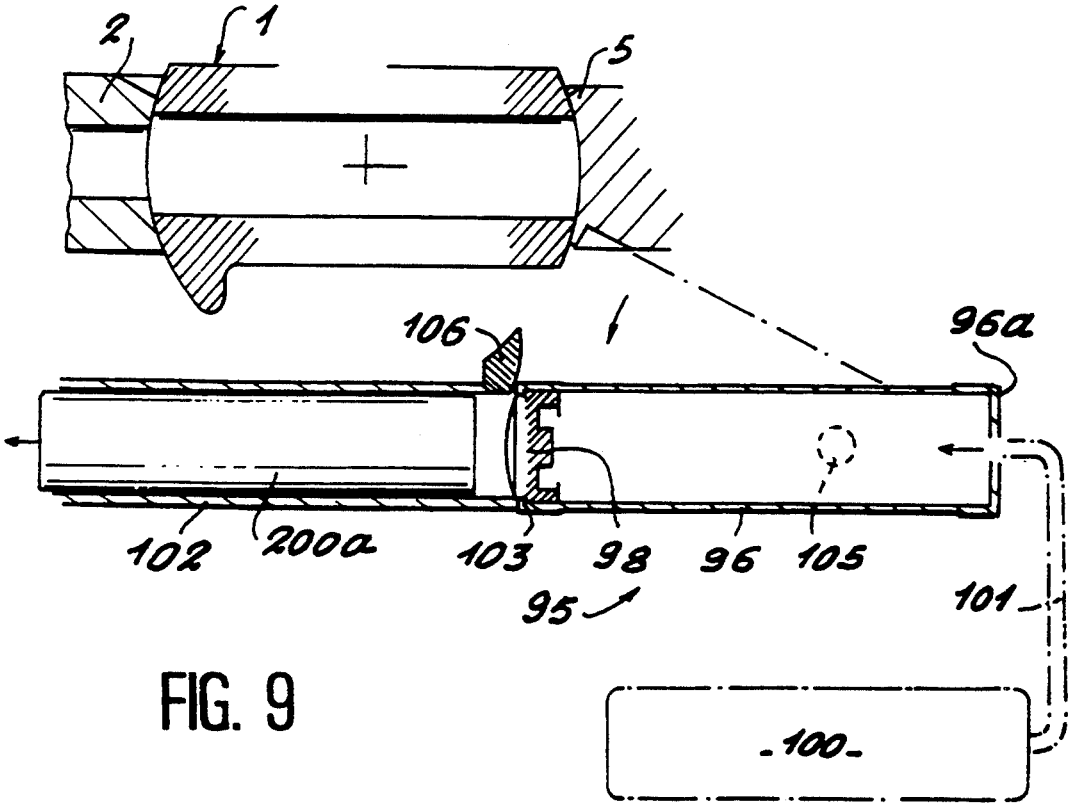

The loading system further includes an ejector device 95, e.g. of the pneumatic type, for ejecting a cartridge case present in the chamber 1. With reference to FIGS. 8 and 9, the ejector device 95 comprises a cylinder 96 that is open at one end and that is closed at its other end by an end wall 96*a*, a piston 98 slidably mounted inside the cylinder 96, a stationary source 100 of fluid under pressure (e.g. air) communicating with the cylinder 96 via a nose 101 that opens out into the end wall 96*a*, and a stationary evacuation chute 102.

Towards its open end, the cylinder 96 includes an internal shoulder 103 for limiting the stroke of the piston 98, with the piston being continuously urged by the fluid under pressure to bear against the shoulder 103.

The cylinder 96 is mounted to pivot in a vertical plane about a horizontal axis embodied at 105. More precisely, the cylinder 96 is mounted parallel to the chamber 1 and its pivoting motion is synchronized with the pivoting motion of the chamber 1. Thus, when the chamber 1 is in its firing position, the cylinder 96 extends parallel to the chamber 1, and when the chamber 1 is in its loading position, the cylinder 96 is in line with the chamber 1, i.e. its open front end is facing the rear end of the chamber 1.

Near its end adjacent to the cylinder 96, the chute 102 includes an abutment 106 which extends radially outwardly towards the chamber 1. The function of the abutment 106 is to retain the cartridge case in the cylinder 96 while the cylinder is pivoting to transfer the cartridge into the chute 102, i.e. while the chamber 1 is moving back to the firing position, however this abutment does not constitute an obstacle when the cylinder 96 is in line with the chamber 1.

Finally, with reference to FIG. 4, the magazine 50 formed at the bottom portion of the case 45 under the feed star 40 has a U-shaped cross-section with the two branches of the U corresponding to two portions 50*a* and 50*b* respectively of the magazine 50. The portion 50*a* can receive rounds from feed station A while the feed star 40 is rotating clockwise, and the portion 50*b* can receive rounds from feed station A1 while the feed star 40 is rotating in the opposite direction. Two pivot levers 110 and 111 connected by a spring 112 project into the inside of the magazine 50. These two levers 110 and 111 are associated with the two magazines 50*a* and 50*b* respectively, and their function is described below.

A round 200 to be loaded follows a path from feed device A1 to the chamber 1 as shown diagrammatically in FIG. 1.

The round 200 is received in loading station 54 of the feed device A1 while in alignment with the trunnion axis of the gun (position $P_1$). The transfer device 55 (FIG. 4) pivots the round 200 through an angle of about 90° to load it onto the feed star 40 (position $P_2$, with an intermediate position $P_{12}$ also being shown). After rotating through one-fourth of a turn in the clockwise direction, the feed star 40 brings the round 200 to the top of the star 40 ($P_3$, with an intermediate position $P_{23}$ also being shown).

Thereafter, the device 64 for taking the round 200 (FIG. 2) extracts the round 200 from the feed star 40 by raising it and causing it to pivot through an angle close to 30° so as to bring it into alignment with the axis of the chamber 1 which is then in the loading position (position $P_4$ with an intermediate position $P_{34}$ also being shown). The loading device 72 loads the round 200 by pushing it into the chamber 1 (position $P_5$). The chamber 1 then pivots towards its firing position so as to be in alignment with the barrel 2 (position $P_6$). After firing, the chamber I pivots back through 30° so as to return to its loading position (position $P_5$).

While a new round is being loaded, the cartridge 200*a* of the round 200 present in the chamber 1 is pushed into the cylinder of the ejector device (position $P_7$) while the new round is being inserted into the chamber 1. As the chamber 1 passes back towards its firing position, the cartridge case 200*a* pivots so as to come into line with the axis of the evacuation chute (position $P_8$ with an intermediate position $P_{78}$ being shown). Finally, the cartridge case 200*a* is ejected into the evacuation chute (position $P_9$).

This technique of loading a round 200 is now described in detail with reference in particular to FIGS. 1 and 5 to 9.

It is assumed initially that a round is at the top of the star 40 (position $P_3$), a round is engaged in the star 40 (position $P_{23}$) and a new round is in the loading station 54 of the feed device A or A1 (position $P_1$).

Figure 5:
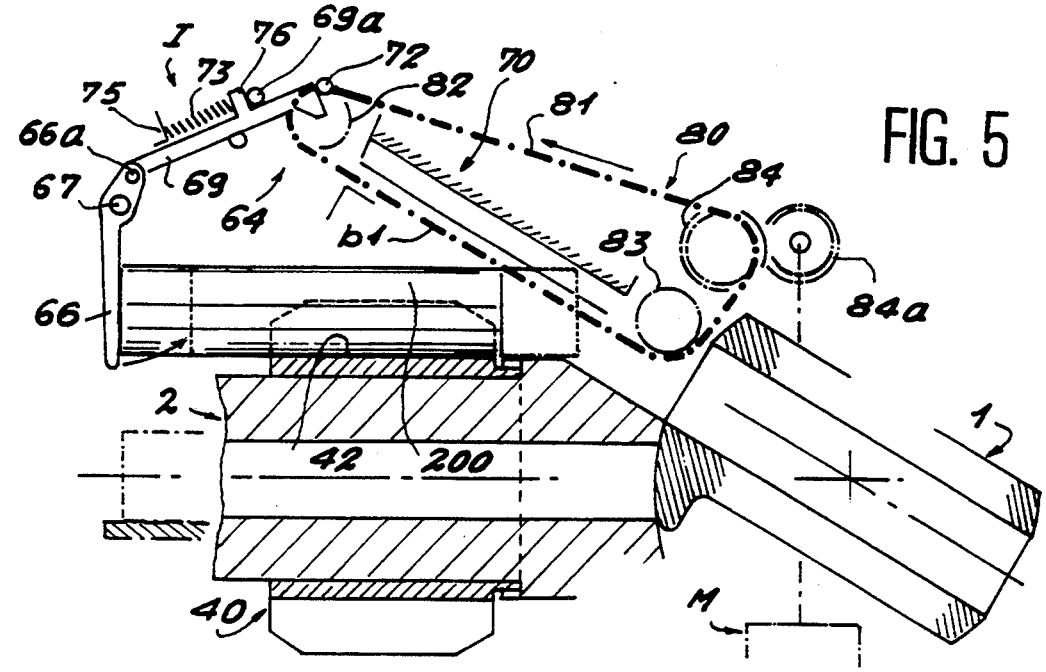
FIGS. 5 to 7 are simplified section views for showing different stages while loading a round into the chamber.

Under such circumstances:

chamber 1 is open or in the loading position, i.e. the wheel 28 of the cam 10 for controlling pivoting of the chamber 1 is at the inlet to sector 20*a* of the groove 20;

the drive finger 60 of the transfer device 55 which is to pivot the new round of the loading station 54 of the feed device A towards the feed star 40 (passing from position $P_1$ to $P_2$) is situated adjacent to the sprocket 57 and in the vicinity of the round;

the device 64 for taking the round situated at the top of the feed star 40 (position $P_3$) has its pivot lever 66 in the vertical position and situated adjacent to the front end of the round (FIG. 5);

the drive rod 72 that controls the round-taking device 64 is situated in the vicinity of the sprocket 82, i.e. it is ready to come into contact with the free end of the sliding lever 69 which controls pivoting of the pivot lever 66 (FIG. 5); and the cylinder 96 of the ejector device 95 is in line with the chamber 1, the piston 98 under drive from the fluid under pressure then being pressed against the shoulder 103 situated at the inlet to the cylinder 96.

The motor unit M is actuated and a rotation cycle of the cam 10 will comprise four stages which are described below, these four stages corresponding respectively to the wheel 28 running along each of the four sectors 20*a* to 20*d* in the groove 20 of the cam 10.

In a first stage corresponding to the wheel 28 running along the sector 20*a* of the groove 20, the chamber 1 remains stationary in the open position, given that the sector 20*a* is centered on the axis of rotation of the cam 10.

In feed device A, the finger 60 driven by the chain 56 bears against the new round 200 and causes it to pivot towards the feed star 40 (FIGS. 3 and 4), the rear end of the round bearing against the circularly arcuate guide rim 35 of the plate 30.

At the insertion device I, the rod 72 driven by the chains 81 going round the two sprockets 82 of the control device 80 comes into contact with the free end of the sliding lever 69 of the device 64 for taking the round situated at the top of the star 40 (FIG. 5). The drive rod 72 pushes the sliding lever 69 against the return force exerted by the spring 73, thereby forming the lever 66 to pivot about its axis 67. The lever 66 which bears against the front portion of the round 200 pushes it towards the chamber 1. As soon as the rear end of the round 200 bears against the guide ramp 70, the round 200 begins to pivot in a vertical plane such that the free end of the lever 66 comes to bear beneath the round 200 so as to raise it while also causing it to pivot through an angle of about 30°, until the round 200 takes up an intermediate position where it bears against the guide ramp 70.

Figure 6:
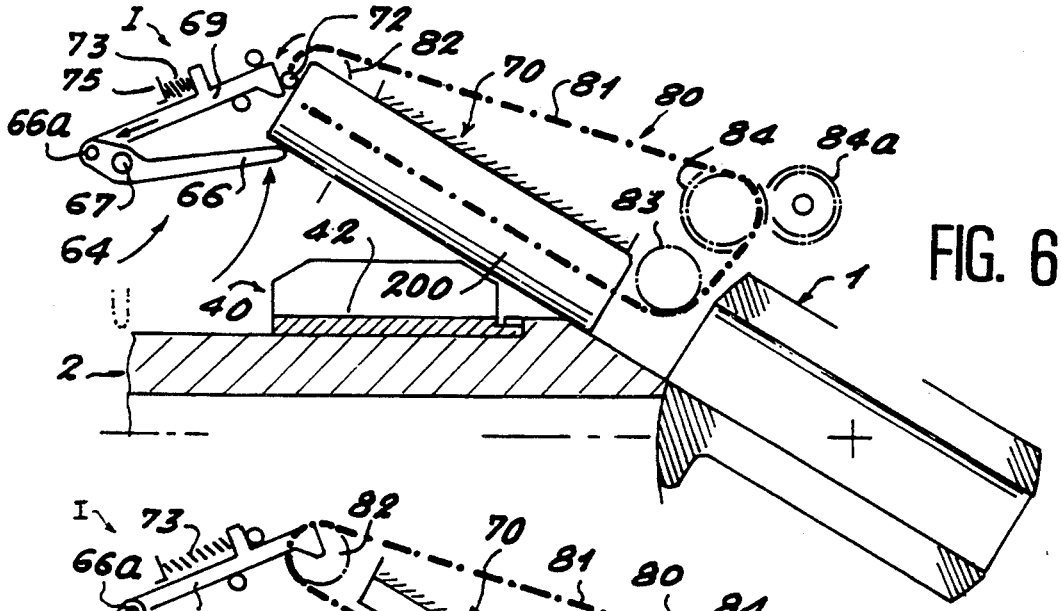
Figure 7:
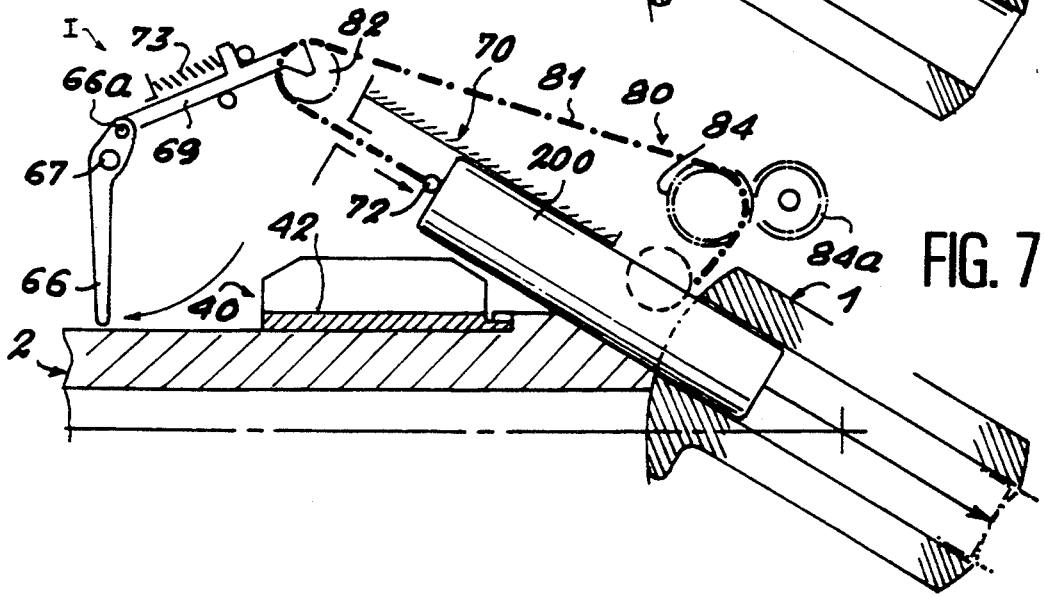

In this intermediate position, shown in FIG. 6, the round 200 is in alignment with the axis of the chamber 1. Once this position has been reached, the drive rod 72 is passed around the sprockets 82, i.e. the drive rod 72 is situated at the end of the lengths b1 of the chains 81 so as to move along said lengths towards the sprockets 83. In other words, the rod 72 comes to bear against the front portion of the round 200 and pushes it into the chamber 1 (FIGS. 6 and 7). If there is a cartridge case 200*a* in the chamber 1, then the round 200 pushes the case 200*a* out into the cylinder 96 of the ejector device 95 (FIG. 8). As it is engaged in the cylinder 96, the case 200*a* pushes back the piston 98 towards the end wall 96*a*.

In a second stage corresponding to the wheel running along the sector 20*b* of the groove 20, the chamber 1 pivots to take up its closed or firing position. During this motion, the cylinder 96 of the ejector device 95 performs the same pivoting motion, with the cartridge case being retained inside the cylinder 96 by virtue of its front end bearing against the abutment 106 secured to the evacuation chute 102.

During this second stage, the drive finger 60 moves from the sprockets 58 to the sprockets 57 and the drive finger 72 moves from the sprockets 83 to the sprockets 82, without performing any action.

In a third stage corresponding to the wheel running along the sector 20*c* of the groove 20, the chamber 1 is held stationary in the closed position, given that the sector 20*c* is centered on the axis of rotation of the cam 10. This is the stage during which the round 200 is fired, and this stage is initiated by the percussion device 70 in conventional manner. When the chamber 1 is in its closed position, the cylinder 96 is in line with the evacuation chute 102, thereby automatically causing the cartridge case 200*a* contained in the cylinder 96 to be ejected into the chute 102 by the piston 98 relaxing. During this third stage, a new round may be put into place in the loading station 54 of the feed device A.

It is important to observe that during the recoil motion of the recoil mass MR of the gun once the round has been fired, the star 40 moves relative to the feed device A, but this movement does not interfere with feed dynamics or with round loading because of the telescopic constant-velocity joints 90 which compensate for this movement without interrupting the transmission between the feed device A and the insertion device I which are controlled synchronously by the motor unit M.

In a fourth and last stage corresponding to the wheel 28 running along the sector 20*d* of the groove 20, the chamber 1 pivots to return to its loading position, the cylinder 96 of the ejector device 95 also pivoting synchronously with the pivoting motion of the chamber 1 so as to come back into alignment with the axis of the chamber 1.

At the end of this fourth stage, the loading system is back in the above-specified initial conditions, with the round 200 that was initially in the loading station 54 of the feed device A now being engaged at the end of this cycle in the feed star 40, and the round that was previously engaged in the star 40 now being at the top of the star. A new cycle can now begin, it being understood that two cycles are required to bring a round from the loading station to the top of the star, with the round then being fired only at the end of the third cycle.

The operation of the loading device has been described with reference to feed device A. When rounds are loaded from feed device A1, the direction of rotation of the feed star 40 must be reversed, but loading takes place in the same manner.

With reference to FIG. 4, the magazine 50 situated beneath the feed star 40 is used mainly when it is necessary to load rounds of another type, while old rounds are still present in the feed star 40.

To dispose of these old rounds, it suffices to rotate the star 40 e.g. in the direction indicated by arrow F2, so that the rounds then engaged in the feed star 40 (at most two rounds occupying the positions $P_{23}$ and $P_3$ in FIG. 1) are directed towards the portion 50*a* of the magazine 50. The first round bears against the arm 110 forcing it to pivot in the direction of arrow F2, while the arm 111 constrained to pivot with the arm 110 pushes back any round that may already be contained in the portion 50*b* of the magazine.

We claim:

1. A gun comprising a support frame;

an oscillating mass pivotally mounted to said support frame for movement about a substantially horizontal trunnion axis;

a recoil mass mounted for movement relative to said oscillating mass during recoil of the gun following the firing of a round; said recoil mass including a gun barrel, a sleeve at one end of said gun barrel, an a pivoting chamber mounted to said sleeve for pivoting movement in a vertical plane between a firing position and a loading position, wherein said firing position and said loading position are angularly offset by an angle between 0° to 90°;

a control device cooperating with said chamber for controlling pivoting of the chamber between said firing position and said loading position;

a feed device for feeding rounds, said feed device being carried by said oscillating mass and located laterally offset relative to said barrel and between said horizontal trunnion axis of the gun and said pivoting chamber;

an insertion device for inserting a round into the chamber when the chamber is in its loading position, said insertion device being secured to said recoil mass and situated above said barrel and substantially in the vertical pivot plane of said chamber; and a feed star mounted for rotation about the sleeve of the gun and operable for conveying each round from said feed device to said insertion device.

2. A gun according to claim 1, wherein the feed device includes a loading station in which each round is substantially in alignment with the trunnion axis of the gun, and a transfer device which conveys the round from the feed station to the feed star by pivoting the round.

3. A gun according to claim 2, wherein the transfer device comprises a drive finger secured to a chain disposed about two sprockets.

4. A gun according to claim 3, wherein the feed device comprises a plate for supporting a round, the portion of the plate situated on the trunnion axis of the gun constituting the loading station, and a support plate situated above the said plate, said support plate supporting the axles of the two sprockets of the transfer device.

5. A gun according to claim 4, wherein when a round is placed in the loading station, a first one of the sprockets is situated in the vicinity of the rear portion of the round, whereas the other sprocket is situated in the vicinity of the feed star, the two sprockets being in alignment on an axis that is at about 45° relative to the axis of the barrel.

6. A gun according to claim 5, wherein two similar feed devices are provided on respective sides of the gun barrel, the feed star being common to both feed devices.

7. A gun according to claim 1, wherein the insertion device for inserting a round into the chamber comprises a round-taking device for taking the round situated at the top of the feed star by pivoting the round in a vertical plane to bring it into an intermediate position where it is in alignment with the axis of the chamber, and a loading device for loading the round into the chamber.

8. A gun according to claim 7, wherein the intermediate position of the round after it has been pivoted is defined by a ramp parallel to the axis of chamber when the chamber is in its loading position.

9. A gun according to claim 8, wherein the round-taking device for taking the round situated at the top of the feed star comprises a pivot lever pivotally mounted in a vertical plane, a sliding lever hinged to the pivot level, and a control device for controlling the sliding lever to cause the pivot lever to pivot.

10. A gun according to claim 8, wherein the sliding lever control device comprises a horizontal drive rod designed to bear against one end of said sliding lever, with a return spring associated with the sliding lever then being compressed.

11. A gun according to claim 10, wherein the drive rod is secured to two chains situated in vertical planes on either side of the round-taking device, each of the chains being disposed around at least two sockets.

12. A gun according to claim 11, wherein the two sprockets of a chain are in alignment with an axis parallel to the axis of the chamber when the chamber is in its loading position.

13. A gun according to claim 11, wherein the drive rod also forms the device for loading the round into the chamber.

14. A gun according to claim 1, wherein during recoil of the gun due to a round being fired, the insertion device for inserting a round into the chamber remains mechanically coupled to the round feed device.

15. A gun according to claim 1, wherein the device for controlling pivoting of the chamber comprises a cam mounted to rotate about an axis perpendicular to the axis of the barrel, and a coupling device mounted between the chamber and the cam to transform the rotary motion of the cam into reciprocating pivoting motion of the chamber.

16. A gun according to claim 15, wherein the coupling device comprises a spur having one end fixed to the chamber, a ball joint slidably mounted on the spur, and a wheel mounted on the ball joint, said wheel being received in a guidepath-forming groove in the cam.

17. A gun according to claim 16, wherein the groove comprise four consecutive sectors along which the wheel runs for one complete rotation of the cam, two opposite sectors each extending over a respective arc of a circle centered on the axis of rotation of the cam, whereas the other two opposite sectors correspond respectively to two opposite-direction pivoting movements of the chamber.

18. A gun according to claim 1, wherein the chamber is associated with an ejector device for ejecting a cartridge case present in the chamber, said device comprising a cylinder open at one end and closed at its other end by an end wall, a piston slidably mounted inside the cylinder, a source of fluid under pressure in communication with the cylinder, and an evacuation chute.

19. A gun according to claim 18, wherein the cylinder is driven with reciprocating pivoting motion synchronously with the pivoting motion of the chamber so as to be in alignment therewith when the chamber is in its loading position, and so as to be in alignment with the chute when the chamber is in its firing position.

20. A gun according to claim 19, wherein the evacuation chute includes an abutment extending radially outwards towards the chamber for the purpose of retaining the cartridge case in the cylinder while the cylinder is pivoting towards the chute.

* * * * *